US011598055B2

(12) United States Patent
Price, II

(10) Patent No.: US 11,598,055 B2
(45) Date of Patent: Mar. 7, 2023

(54) MOBILE RUBBER APPLICATOR WITH WIDE-AREA CERAMIC BLANKET HEATER

(71) Applicant: David W. Price, II, Indianapolis, IN (US)

(72) Inventor: David W. Price, II, Indianapolis, IN (US)

( * ) Notice: Subject to any disclaimer, the term of this patent is extended or adjusted under 35 U.S.C. 154(b) by 101 days.

(21) Appl. No.: 16/798,317

(22) Filed: Feb. 22, 2020

(65) Prior Publication Data

US 2020/0270825 A1 Aug. 27, 2020

Related U.S. Application Data

(60) Provisional application No. 62/919,015, filed on Feb. 22, 2019.

(51) Int. Cl.

| | |
|---|---|
| ***E01C 19/45*** | (2006.01) |
| ***E01C 23/09*** | (2006.01) |
| ***E01C 19/10*** | (2006.01) |
| ***E01C 23/06*** | (2006.01) |
| ***E01C 19/16*** | (2006.01) |
| ***E01C 19/46*** | (2006.01) |

(52) U.S. Cl.

CPC ..... *E01C 23/0973* (2013.01); *E01C 19/1004* (2013.01); *E01C 19/16* (2013.01); *E01C 19/45* (2013.01); *E01C 19/46* (2013.01); *E01C 23/065* (2013.01); *E01C 23/0966* (2013.01)

(58) Field of Classification Search

CPC ..... E01C 19/16; E01C 19/45; E01C 19/46; E01C 23/0973

USPC ..... 404/95, 111

See application file for complete search history.

(56) References Cited

U.S. PATENT DOCUMENTS

| | | | | | |
|---|---|---|---|---|---|
| 1,546,185 | A * | 7/1925 | Andresen | E01C 19/10 | 404/95 |
| 1,849,581 | A * | 3/1932 | Littleford, Jr. | E01C 23/06 | 404/95 |
| 1,931,793 | A * | 10/1933 | Gleason | E01C 23/0973 | 404/95 |
| 3,804,079 | A * | 4/1974 | Schrader | C10C 3/12 | 126/343.5 A |
| 4,192,288 | A * | 3/1980 | Heller | C10C 3/12 | 126/343.5 A |
| 4,964,752 | A * | 10/1990 | Astrope | B05D 7/22 | 404/111 |
| 5,223,005 | A * | 6/1993 | Avondoglio | B01D 46/0068 | 55/291 |
| 5,325,994 | A * | 7/1994 | Mizialko | B67D 7/80 | 222/113 |

(Continued)

*Primary Examiner* — Gary S Hartmann

(74) *Attorney, Agent, or Firm* — Overhauser Law Offices, LLC

(57) ABSTRACT

Applicator and method for applying melted rubber to pavement comprises a melting vat having a substantially planar bottom with a surface area, and a wide-area a heating element beneath the melting vat having a surface area more than half the surface area of the planar bottom of the melting vat and positioned beneath the melting vat. The heating element may be comprised of an aluminum oxide ceramic blanket. A double-walled construction of the vat with exhaust holes in the outer wall allows exhaust to evenly melt rubber in the vat to reduce burning of the rubber, flame blowouts, and improve fuel efficiency.

9 Claims, 2 Drawing Sheets

(56) References Cited

U.S. PATENT DOCUMENTS

| | | | | |
|---|---|---|---|---|
| 6,109,826 | A * | 8/2000 | Mertes | E01C 19/45 392/472 |
| 6,439,806 | B1 * | 8/2002 | Dillingham | E01C 19/45 126/343.5 A |
| 6,935,331 | B2 * | 8/2005 | Farmer | C10C 3/12 126/343.5 A |
| 9,347,187 | B2 * | 5/2016 | Coe | E01C 11/005 |
| 9,739,021 | B1 | 8/2017 | Kuhn et al. | |
| 10,053,823 | B2 | 8/2018 | Kuhn et al. | |
| 11,066,792 | B2 * | 7/2021 | Price, II | E01C 23/0973 |

* cited by examiner

MOBILE RUBBER APPLICATOR WITH WIDE-AREA CERAMIC BLANKET HEATER

CROSS REFERENCE TO RELATED APPLICATIONS

This application claims the benefit of Provisional Application No. 62/919,015 filed 22 Feb. 2019, the contents of which are incorporated herein by reference.

FIELD OF THE INVENTION

The present invention relates to rubber applicators that apply melted rubber to cracks or joints in pavement.

BACKGROUND

Rubber applicators are mobile devices that are rolled along cracks in pavement to apply melted rubber to fill the cracks. They typically have a vat for holding rubber blocks, and a heating element to melt the rubber and keep it at a desired temperature during the application process. It is desirable for rubber applicators to avoid overheating or burning the rubber in the vat, to be easy to clean and maintain, and to avoid concentrating a flame to single spot beneath the vat. It is also desirable to provide a rubber applicator in which the heating element is unlikely to blowout.

SUMMARY OF THE INVENTION

An applicator for applying melted rubber to pavement comprises a melting vat having a substantially planar bottom with a surface area, and a wide-area a heating element beneath the melting vat having a surface area at least half the surface area of the planar bottom of the melting vat. A double-walled construction of the vat includes exhaust holes in the outer wall that allow exhaust to evenly melt rubber in the vat, to reduce burning of the rubber and flame blowouts, and to improve fuel efficiency.

DETAILED DESCRIPTION

Figure 1:
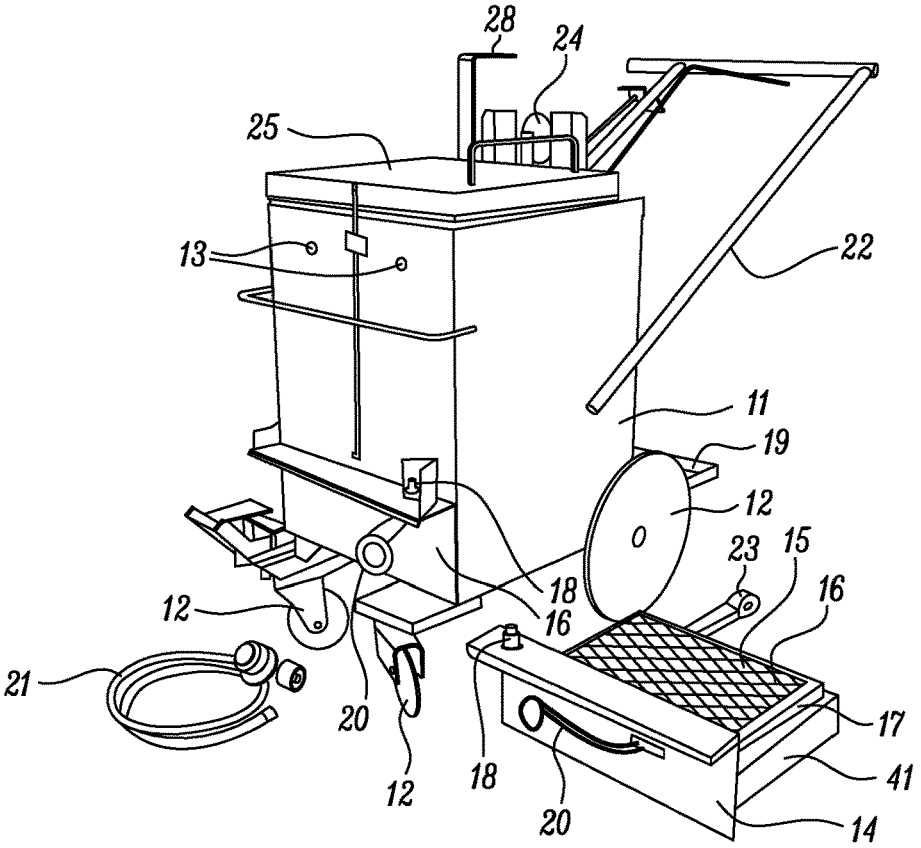
FIG. 1 shows a rubber applicator with a below-vat heating element.

FIG. 1 shows a rubber applicator with a below-vat heating element 15, and a separate tray holding the heating element. Vat 11 is spaced from the ground by wheels 12.

Figure 3:
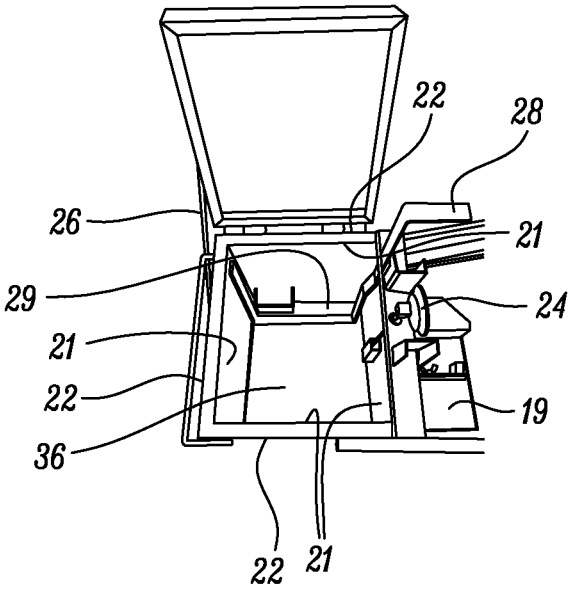
FIG. 3 shows the interior vat of a rubber applicator.

In one embodiment, vat 11 may be double-walled, i.e., comprised of inner 21 and outer 22 walls as shown in FIG. 3. Both walls may be formed of 14 gauge steel. As best shown in FIG. 3, the sides of vat 11 are thick because they have this double-wall construction. This results in a space between the inner wall 21 and outer wall 22. The upper portions of the outer wall may include exhaust holes 13. When a heating element 15 positioned beneath vat 11 is used as described below, exhaust from heating element 15 circulates upward and between the inner and outer walls, thus imparting heat to the rubber in the vat from both the bottom and sides. This promotes even heating of the rubber, and reduces hotspots and burning of rubber.

Vat 11 includes a solid metal bottom 36 having a surface area. Beneath the bottom, the applicator includes a tray 14 that holds a wide-area heating element 15 having a surface area sized to be more than half the surface area of the planar bottom of the melting vat and positioned beneath the melting vat bottom 36. Tray 14 is slidably removable from the applicator. Tray 14 is shown removed from the applicator, while tray 16 is shown inserted into the applicator. Tray also holds fuel inlet port 23 which provides fuel to heating element 15 via fuel hose and regulator 21.

In one embodiment, heating element 15 in tray 14 may comprise an aluminum oxide ceramic heating blanket, and be covered by an expanded metallic grid 16 to keep it in place over a 2.5" deep air tight pan. Metallic grid 16 may be held in place by Z-channel 17 which is attached to tray support 41. The perimeter of the Z-channel may be secured by #12 self-tapping screws while fully compressing the ceramic heating blanket 15 at the perimeter to create a gasket seal. When inserted into the applicator, heating element 15 may be slightly spaced from the bottom of vat 26 to thereby permit fuel exhaust to flow upwards between the inner wall 21 and outer wall 22 of vat 11, and to exit through the exhaust holes 13. This upward flow of heated exhaust imparts heat to rubber in vat 11 both from the vat bottom 36 and inner walls 21. This improves the even heating of the rubber, and reduces hotspots and burning of rubber, which consequently improves the quality of applied rubber, and makes the interior of the vat easier to clean between uses.

Figure 4:
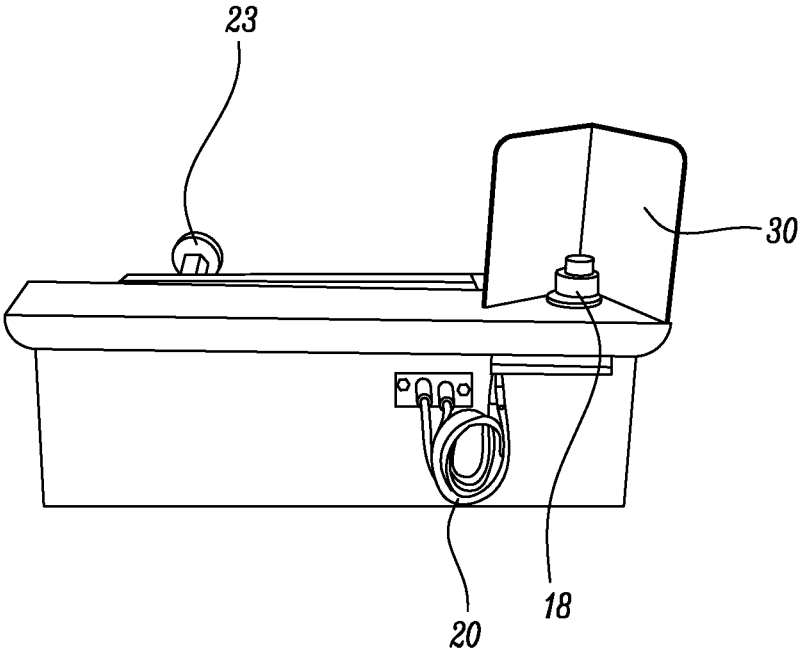
FIG. 4 is a front view of a tray holding a ceramic blanket heating element and ignitor that is slidably insertable into the applicator of FIG. 1.

Tray 14 also includes ignitor button 18 which via wires 20 is in electrical communication with a battery-powered spark ignitor which extends through the front the shelf 14 to engage heating element 15. As shown in FIG. 4, V-shaped metallic heat guard 40 extends upward from the front of tray 14, to reduce the ambient heat ignitor button might receive from vat 11.

Also shown in FIGS. 1 and 3 is shelf 19, which is adapted to hold a propane fuel tank (not shown) to supply fuel to heating element 15 via fuel hose and regulator 21 and fuel inlet port 23. The fuel hose may be comprised of braided stainless steel wrap. In one embodiment, the regulator is self-maximizing to prevent over pressurizing of heating element 15. Attached to vat 11 is rear handle 22 which facilitates pushing of the applicator along pavement having a crack into which melted rubber is to be dispensed. Applicator may further include thermometer 24 which comprises a sensor extending into the interior of the vat and a gauge on the exterior of the vat so the operator may monitor the temperature of rubber in the vat. 21. The temperature of the rubber may be altered by adjusting a fuel valve on the propane tank.

FIG. 3 shows the interior vat of a rubber applicator. Vat lid 25 is hingedly connect to the vat. When opened, blocks of rubber may be inserted into the vat. Lid holder 26 engages catch 27 (in FIG. 2) which holds lid 25 open. Agitator arm 28 may be pivoted back and forth so its lower portion 29 mixes melted rubber. The vat has a substantially planar bottom 36 which has a surface area. When tray 14 with heating element 15 is inserted into the applicator, the surface area of heating element 15 is adjacent a majority of the surface area of the vat bottom 36. By imparting heat to more than half the surface area of the planar bottom of the melting vat, instead of concentrating the heat on a small portion of vat bottom, the disclosed embodiment melts rubber in the vat more evenly and efficiently. In addition, the use of the ceramic blanket heating element 15 prevents blowouts, especially when the heating element is of a construction that includes Z-channel 17, which shields heating element 15 from wind.

Figure 2:
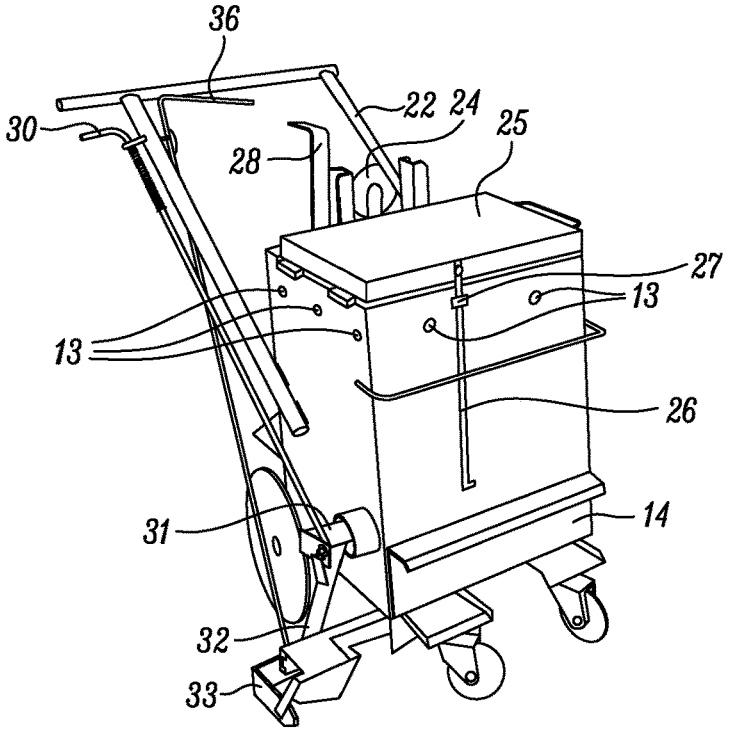
FIG. 2 shows the exterior of an applicator and its valve and discharge components.

Referring to FIG. 2, once rubber in the vat is melted to a desired temperature, valve handle 30 may be squeezed which opens valve 31 to permit melted rubber to be discharged and flow through rubber exit port 35 out of the vat, down tube 32 and to the crack in the pavement to be filled. Shoe 33 includes a horizontal surface that levels the applied rubber as the vat is pushed forward using handle 22 to achieve a professional appearance and allow melted rubber to be applied along a continuous line on the pavement. The height of shoe 33 with respect to the ground may be controlled by actuating shoe control lever 36.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. An applicator for applying melted rubber to pavement comprising:

a melting vat having a substantially planar bottom, sides and a rubber exit port such that melted rubber in the vat can flow by force of gravity onto the pavement, the planar bottom of the melting vat having a surface area, a valve for controlling a discharge of melted rubber through the rubber exit port, the applicator having a plurality of ground engaging members, each ground engaging member comprising a ground-engaging wheel;

a handle connected to the vat to allow it to be pushed;

a valve actuator handle proximate the handle to allow the valve to be controlled, a heating element having a surface area more than half the surface area of the planar bottom of the melting vat and positioned beneath the melting vat, such that heat from the heating element projects upward to thereby engage the substantially planar bottom of the melting vat, the heating element positioned on a slidable tray, the slidable tray comprising a bottom surface preventing the heating element from exposure to the pavement;

a Z-Channel extending upward from the slidable tray to thereby shield the heating element from wind, and a fuel inlet port in communication with the heating element.

2. The applicator for applying melted rubber to pavement of claim 1 wherein:

the heating element comprises a ceramic blanket.

3. The applicator for applying melted rubber to pavement of claim 1 wherein:

the sides of the vat comprise an inner wall and an outer wall defining a space therebetween that is in communication with the heating element, and wherein the exterior wall has a plurality of exhaust holes to thereby allow fuel exhaust from the heating element to flow upward between the inner and outer walls of the vat and to exit through the exhaust holes.

4. The applicator for applying melted rubber to pavement of claim 1 wherein:

the heating element is on a tray that is slidably removable from the applicator.

5. The applicator for applying melted rubber to pavement of claim 1 further comprising a spark ignitor in communication with the heating element.

6. The applicator for applying melted rubber to pavement of claim 1 further comprising a shelf extending from the melting vat adapted to hold a fuel tank.

7. A vat for preparing rubber for application to pavement comprising:

a melting vat having a substantially planar bottom having a surface area, bottom edges, sides and a rubber exit port such that melted rubber in the vat can flow by force of gravity onto the pavement, a hinged lid affixed to the vat movable between an open position in which the vat is exposed to the exterior to allow blocks of solid rubber to be placed in the melting vat and a closed position in which the lid covers the vat, a handle connected to the vat to allow it to be pushed;

a valve actuator handle to allow the valve to be controlled, a heating element having a surface area more than half the surface area of the planar bottom of the melting vat and positioned beneath the melting vat, such that heat from the heating element projects upward to thereby engage the substantially planar bottom of the melting vat, the heating element positioned on a slidable tray, the slidable tray comprising a bottom surface preventing the heating element from exposure to the pavement;

a Z-Channel extending upward from the slidable tray to thereby shield the heating element from wind, and a fuel inlet port in communication with the heating element.

8. An apparatus for providing sealant to be applied to pavement cracks comprising:

a melting vat having a bottom, sides and a rubber exit port such that melted rubber in the vat can flow by force of gravity from the vat, the bottom of the melting vat having a surface area, a valve for controlling a discharge of melted rubber through the rubber exit port, the apparatus having a plurality of ground engaging members;

at least one handle connected to the vat to allow it to be moved;

a valve actuator handle allowing the valve to be controlled, a lid affixed to the vat movable between an open position in which the vat is exposed to the exterior to allow blocks of solid rubber to be placed in the melting vat and a closed position in which the lid covers the vat a heating element having a surface area more than half the surface area of the bottom of the melting vat and positioned beneath the melting vat, such that heat from the heating element projects upward to thereby engage the bottom of the melting vat, the heating element positioned on a slidable tray, the slidable tray comprising a bottom surface preventing the heating element from exposure to the pavement;

a Z-Channel extending upward from the slidable tray to thereby shield the heating element from wind, and a fuel inlet port in communication with the heating element.

9. The apparatus of claim 8 wherein the heating element comprises a ceramic blanket.

* * * * *